US008162781B2

(12) United States Patent
Heflin, Sr.

(10) Patent No.: US 8,162,781 B2
(45) Date of Patent: Apr. 24, 2012

(54) TRAINING APPARATUS, GLOVE AND METHOD FOR PROMOTING BASKETBALL SHOOTING SKILLS

(76) Inventor: Ronald L. Heflin, Sr., Merrillville, IN (US)

( * ) Notice: Subject to any disclaimer, the term of this patent is extended or adjusted under 35 U.S.C. 154(b) by 234 days.

(21) Appl. No.: 12/755,732

(22) Filed: Apr. 7, 2010

(65) Prior Publication Data

US 2010/0261558 A1 Oct. 14, 2010

Related U.S. Application Data

(60) Provisional application No. 61/167,637, filed on Apr. 8, 2009, provisional application No. 61/174,042, filed on Apr. 30, 2009.

(51) Int. Cl.
*A63B 69/00* (2006.01)

(52) U.S. Cl. ..... 473/448; 473/450

(58) Field of Classification Search ..... 473/415, 473/422, 446, 447, 448; D21/781
See application file for complete search history.

(56) References Cited

U.S. PATENT DOCUMENTS

| | | | | |
|---|---|---|---|---|
| 2,918,283 | A | 12/1959 | Marschalk | |
| 3,160,414 | A | 12/1964 | Gray | |
| 3,501,773 | A | 3/1970 | Stansberry et al. | |
| 3,606,614 | A | 9/1971 | Dimitroff | |
| 3,707,730 | A * | 1/1973 | Slider | 2/161.1 |
| 4,206,915 | A | 6/1980 | Woodcock | |
| 4,738,447 | A | 4/1988 | Brown | |
| 4,881,275 | A | 11/1989 | Cazares et al. | |
| 5,135,217 | A | 8/1992 | Swain | |
| 5,500,956 | A | 3/1996 | Schulkin et al. | |
| D368,942 | S | 4/1996 | Mahoney | |
| 5,603,495 | A | 2/1997 | Noveck | |
| 5,636,381 | A | 6/1997 | Brogden | |
| 5,665,016 | A * | 9/1997 | Burnett | 473/448 |
| 5,800,290 | A | 9/1998 | Barry | |
| D416,601 | S * | 11/1999 | Gurley | D21/807 |
| 6,049,910 | A | 4/2000 | McCarter | |
| 6,182,293 | B1 | 2/2001 | Mustin | |
| 6,190,270 | B1 | 2/2001 | Barry | |
| 6,223,353 | B1 | 5/2001 | Lardieri, Jr. | |
| 6,458,050 | B2 | 10/2002 | Barry | |
| 6,729,979 | B1 | 5/2004 | Sullivan | |
| 6,912,731 | B2 | 7/2005 | Cass | |
| 6,913,551 | B1 | 7/2005 | Foley | |
| 6,932,723 | B1 | 8/2005 | Klinger et al. | |
| D532,476 | S | 11/2006 | Coryatt | |
| D535,715 | S | 1/2007 | Coryatt | |
| 7,437,776 | B1 * | 10/2008 | Brown | 2/160 |
| 7,442,133 | B2 | 10/2008 | Wolf | |

(Continued)

*Primary Examiner* — Gene Kim
*Assistant Examiner* — M Chambers
(74) *Attorney, Agent, or Firm* — Hartman & Hartman, P.C.; Gary M. Hartman; Domenica N. S. Hartman

(57) ABSTRACT

A system and training method adapted to assist an individual in improving his or her basketball shooting skills and accuracy. The system includes an apparatus and glove that can be used independently or together. The apparatus is adapted for mounting to a basketball rim and includes flexible paddles for mounting to the rim so that the paddles project upwardly from the rim. The glove is adapted to be worn on the shooting hand and includes fingers, wrist and backhand portions. The fingers portion has three separate sleeves interconnected by elastic webs therebetween. The backhand portion interconnects the fingers portion to the wrist portion. The glove is configured so that the three middle fingers of the shooting hand are individually inserted into the sleeves and elastically held together by the webs, while allowing the thumb and outer finger of the shooting hand to spread outward and support the basketball during shooting.

18 Claims, 2 Drawing Sheets

U.S. PATENT DOCUMENTS

| | | | | |
|---|---|---|---|---|
| 7,475,433 | B2 | 1/2009 | Coulter et al. | |
| 2002/0077200 | A1 * | 6/2002 | Kreutzer | 473/450 |
| 2004/0043841 | A1 | 3/2004 | Williams | |
| 2008/0280705 | A1 | 11/2008 | LaPergola | |
| 2009/0318248 | A1 * | 12/2009 | Russotti | 473/450 |
| 2010/0261558 | A1 * | 10/2010 | Heflin, Sr. | 473/448 |

* cited by examiner

TRAINING APPARATUS, GLOVE AND METHOD FOR PROMOTING BASKETBALL SHOOTING SKILLS

CROSS REFERENCE TO RELATED APPLICATIONS

This application claims the benefit of U.S. Provisional Application No. 61/167,637 filed Apr. 8, 2009, and U.S. Provisional Application No. 61/174,042 filed Apr. 30, 2009. The contents of these prior applications are incorporated herein by reference.

BACKGROUND OF THE INVENTION

The present invention generally relates to sports training equipment and techniques. More particularly, this invention relates to an apparatus, a glove and training methods adapted to assist an individual in improving his or her basketball shooting skills and accuracy at all playing levels.

Various basketball training equipment and methods have been proposed. A notable example is an apparatus disclosed in U.S. Pat. No. 6,881,161 to Heflin, Sr., whose contents are incorporated herein by reference. Heflin, Sr., discloses a basketball training apparatus comprising a base intended to be placed beneath a basketball rim, arms extending in radial directions from the base, shooting markers spaced along the length of each arm, and one or more vision markers adapted to be attached to the basketball rim and radially aligned with the arms. With this arrangement, a user, when standing on one of the shooting markers and facing the basketball rim, is provided with visual shooting assistance as a result of the arm being radially aligned with one of the vision markers located on a region of the basketball rim nearest the user, and therefore readily visible to the user. The apparatus is capable of improving shooting skills and accuracy on all playing levels, e.g., from elementary to professional.

Various other types of basketball training equipment and accessories have also been proposed. For example, U.S. Pat. No. 6,932,723 to Klinger et al., U.S. Pat. No. Des. 368,942 to Mahoney, and U.S. Published Patent Application No. 2004/0043841 to Williams disclose basketball shooting aids that comprise a rigid barrier or wall placed above and along a basketball rim for the purpose of deflecting undesirable basketball shots. U.S. Pat. No. 4,206,915 to Woodcock is similar, but discloses the use of multiple targets rather than a single barrier or wall. Proposed accessories have included gloves intended to be worn during training to promote a shooter's grip, finger positioning, etc. Typically such gloves are equipped with sleeves for each finger and the thumb, and often cover the palm of the shooting hand.

BRIEF DESCRIPTION OF THE INVENTION

The present invention provides a basketball shooting system and training method adapted to assist an individual in improving his or her basketball shooting skills and accuracy. The system includes an apparatus and glove that can be used independently or together.

According to a first aspect of the invention, the apparatus is adapted for mounting to a basketball rim and includes a plurality of flexible paddles, means for mounting the flexible paddles to the rim so that the flexible paddles project upwardly from the rim, and means coupled to the flexible paddles for adjustably modifying the rigidity of the flexible paddles.

According to a second aspect of the invention, the glove is adapted to be worn on a shooting hand of a user when shooting a basketball at the rim. The glove includes a fingers portion, a wrist portion, and a backhand portion. The fingers portion comprises three separate sleeves interconnected by a first elastic web between and attached to an adjacent first and second of the sleeves and by a second elastic web between and attached to the second sleeve and an adjacent third of the sleeves. The wrist portion comprises means for securing the glove to a wrist of the user, and the backhand portion interconnects the fingers portion to the wrist portion. The glove is configured so that, when worn on the user's shooting hand, most if not all of the palm of the shooting hand remains exposed and is not covered by the glove, the three middle fingers of the shooting hand are individually inserted into the sleeves and held together by the first and second elastic webs, and at least the tips of the three middle fingers protrude from the sleeves. The elasticity of the elastic material of the fingers portion enables the three middle fingers to be spread apart against an elastic tension created by the first and second elastic webs, which maintains the three middle fingers closer to each other than to the thumb and outer finger of the shooting hand during shooting.

Other aspects of the invention include training methods using the apparatus and/or glove described above. If the apparatus and glove are used together, the apparatus is installed on the rim, the glove is donned on the shooting hand of the user, and the user uses the shooting hand to shoot a basketball toward the rim and over one of the flexible paddles secured to the rim.

A significant advantage of the apparatus of this invention is that the flexible paddles provide flexibility yet provide some resistance when hit by a basketball to allow the basketball to enter the rim if shot with a sufficiently high arc and sufficient accuracy, but prevent the ball from entering the rim if the shot does not have sufficient arc and is not sufficiently accurate. The ability to adjust the flexibility of the paddles enables the apparatus to be adjusted for the skill level of the user. The flexible paddles can be color-coded to help the user visually align his or her shot relative to the rim by differentiating as to which paddle he or she must shoot over.

A significant advantage of the glove of this invention is that the elasticity of the webs limits the flexing and spreading of the three middle fingers of the shooting hand (the dominant hand used by the shooter) to allow a basketball to be properly supported by the three middle fingers and align the three middle fingers with the forearm of the shooting hand while the user is shooting the basketball and thereafter throughout the follow-through following release of the basketball, while allowing the thumb and outer ("pinky") finger of the shooting hand to freely flex and spread out away from the three middle fingers to stabilize the basketball on the shooting hand prior to releasing the basketball during the shooting movement.

Other aspects and advantages of this invention will be better appreciated from the following detailed description.

DETAILED DESCRIPTION OF THE INVENTION

Figure 1:
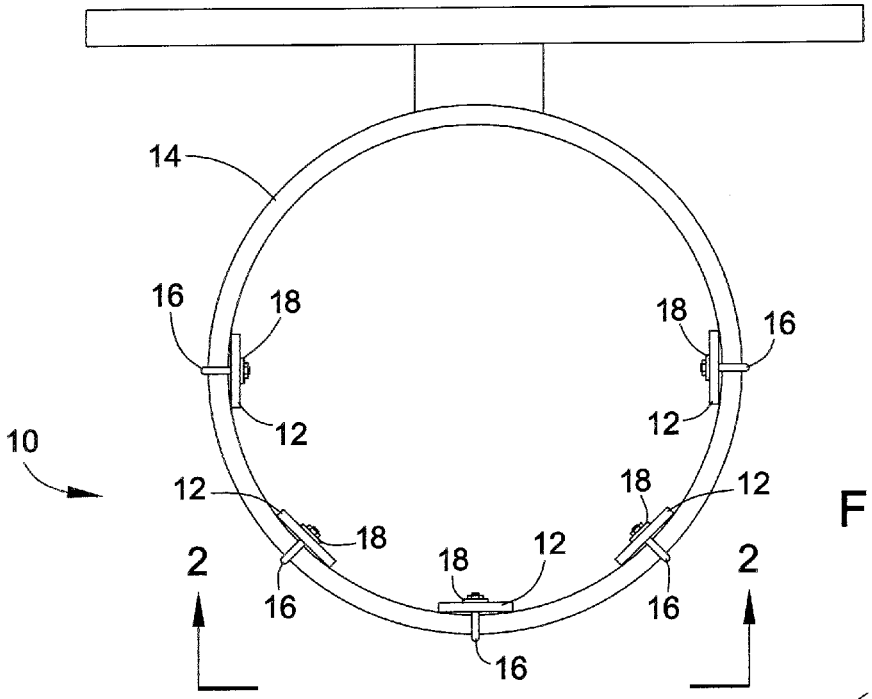
FIGS. 1 and 2 are top and side views, respectively, of a conventional basketball rim on which multiple flexible paddles of a basketball shooting apparatus are mounted in accordance with an embodiment of this invention.
Figure 2:
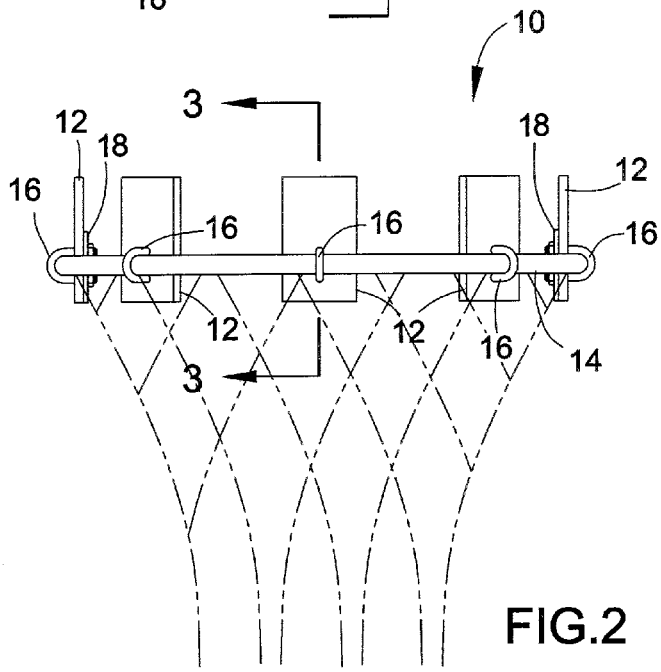

FIGS. 1 through 5 depict a basketball shooting apparatus 10 and a basketball shooting glove 50 that can be used individually or together to improve the shooting accuracy of a basketball player. The apparatus 10 is represented in FIGS. 1 and 2 as comprising five paddles 12 that are attached to the inner perimeter of a basketball rim 14. The paddles 12 compel a shooter to shoot a basketball with sufficient arc so that the basketball travels over the paddle 12 with which the shot is aligned in order for the basketball to enter the interior of the rim 14.

According to a preferred aspect of the invention, the paddles 12 located at the far left (leftmost) and far right (rightmost) of the rim 14 (as viewed in FIGS. 1 and 2) are represented as being located diametrically opposite each other on the rim 14, though other locations for these particular paddles 12 are foreseeable. The center paddle 12 (as viewed in FIGS. 1 and 2) is equi-angularly located between the leftmost and rightmost paddles 12, and the two remaining paddles 12 are represented as being equi-angularly located between either the leftmost and center paddles 12 or the rightmost and center paddles 12. Again, these are believed to be preferred locations for the paddles 12, and it is foreseeable that alternative locations could be chosen. Furthermore, the paddles 12 could be used in fewer or greater numbers.

The paddles 12 are shown as being individually attached to the rim 14 with U-bolts 16, whose threaded ends pass through a plate 18 abutting against the surfaces of the paddles 12 facing the interior of the rim 14. Various other techniques for securing the paddles 12, individually or collectively, to the rim 14 are foreseeable and within the scope of the invention. The paddles 12 are formed of a firm but pliable/flexible material, such as a thick rubber material having a thickness of, for example, about five to fifteen millimeters, to confer a degree of flexibility so that the paddles 12 will allow a basketball to enter the rim 14 if shot with sufficient accuracy and a sufficiently high arc, but prevent the ball from entering the rim 14 if the shot does not have sufficient arc and is not sufficiently accurate. To promote shots taken with a high arc, the paddles 12 are preferably of sufficient length so that the paddles 12 extend vertically about five to about six inches (for example, about ten to fifteen centimeters) above the rim 14. Furthermore, the paddles 12 are preferably about two to about three inches (for example, about five to ten centimeters) wide as measured in the circumferential direction of the rim 14.

In addition to assisting in the securement of the paddles 12 to the rim 14, the plates 18 are located at the inward-facing surfaces of the paddles 12 to provide additional rigidity and back-support to the paddles 12 when impacted by a basketball traveling toward the rim 14. The plates 18 preferably do not extend the entire vertical height of the paddles 12, but instead extend only a fraction (for example, about one-fourth to about one-half) of the vertical height of each paddle 12. Furthermore, the plates 18 are preferably vertically adjustable relative to their respective paddles 12 to enable the flexibility/rigidity of the paddles 12 to be varied to accommodate various skill levels of shooters. For this purpose, openings in the plates 18 through which the threaded ends of the U-bolts 16 pass can be vertically elongated. Vertical adjustment of the paddles 12 is preferably at least five millimeters and can be adjusted to extend to roughly the mid-length point of the paddles 12, especially if the paddles 12 are formed of a rubber material. According to another preferred aspect of the invention, the paddles 12 can be color-coded (for example, each paddle 12 having a different color from the others) to help the shooter differentiate as to which paddle 12 he or she must shoot over, thereby assisting the shooter to align the shot with the center of the rim 14.

Figure 4:
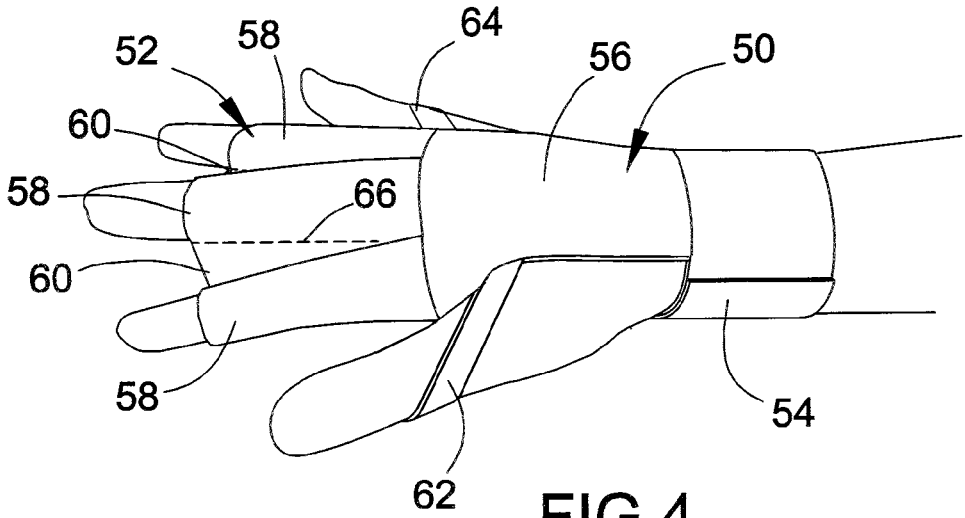
FIGS. 4 and 5 are views of a basketball shooting glove in accordance with another embodiment of this invention.
Figure 5:
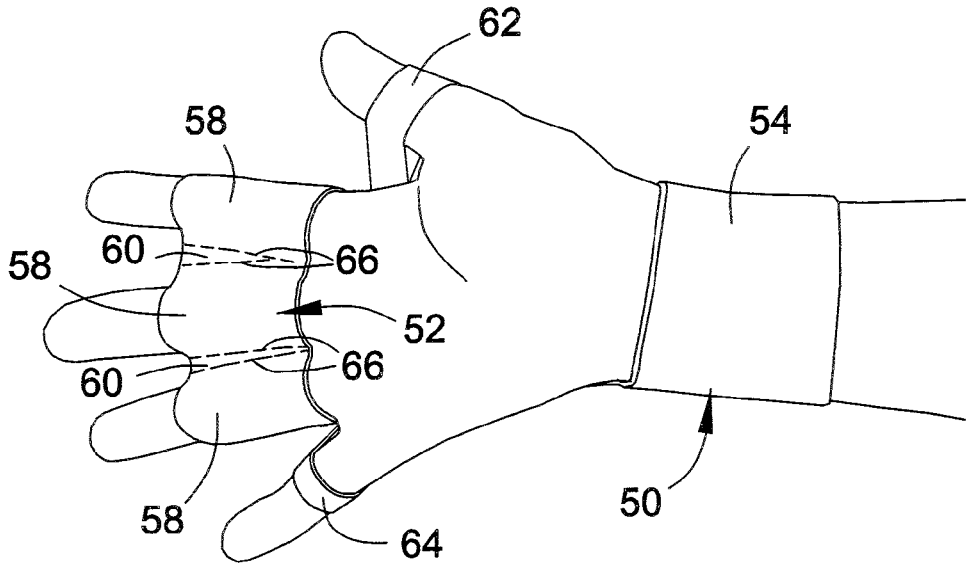

The basketball shooting glove 50 of this invention is intended to be worn on the user's shooting hand, i.e., the dominant hand used to propel the ball. Accordingly, the glove 50 will be fabricated to be worn on either the left or right hand, depending on the shooter. A right-handed glove 50 is represented in the Figures. The glove 50 is shown as having three main portions: a fingers portion 52, a wrist portion 54, and a backhand portion 56. The fingers portion 52 has three separate sleeves 58 that are interconnected by two elastic webs 60, each between an adjacent pair of the sleeves 58. When the glove 50 is worn, the user's three middle fingers are inserted into the sleeves 58 and the elasticity of the webs 60 serves to keep the middle fingers close together during the shooting motion leading up to release of the basketball as well as after the basketball has been released by the shooting hand. The fingers portion 52 can be constructed by forming a ring or band of an elastic material, and the sleeves 58 and webs 60 can be defined in the ring/band by stitches 66. Any number and type of stitches 66 and stitch patterns can be used, and the stitching material can be elastic or inelastic. The stitches 66 preferably run in a direction roughly parallel to the axis of the ring/band, so that the stitches 66 delineate the sleeves 58 and form the webs 60 to be roughly parallel to each other. With this construction, the sleeves 58 and webs 60 are both elastic. As shown in FIGS. 4 and 5, at least the tip and preferably the entire last joint of each of the three middle fingers protrudes from the sleeves 58.

The glove 50 is further represented as including two ringlets 62 and 64 for the thumb and outer finger, respectively. The ringlets 62 and 64 are preferably attached to the lateral edges of the backhand portion 56 and can be, but are not required to be, formed of an elastic material. The ringlets 62 and 64 allow the thumb and outer finger of the shooting hand to freely flex and spread out away from the three middle fingers and stabilize the basketball on the shooting hand prior to releasing the basketball during the shooting movement, whereas during the same motion the elasticity of the fingers portion 52 and particularly its webs 60 generate an elastic tension that maintains the three middle fingers of the shooting hand closer to each other than to the thumb and outer finger of the shooting hand.

The wrist portion 54 is preferably formed of a substantially inelastic material, such as cloth, leather, etc., though it is foreseeable that an elastic material could be used in the construction of the wrist portion 54. The wrist portion 54 is sized to completely circumscribe the wrist of the user's shooting hand, and can be fastened with VELCRO® or any other suitable type of fastening system capable of securing the glove 50 to the wrist.

The backhand portion 56 is also preferably formed of a substantially inelastic material, such as cloth, leather, etc., though it is also foreseeable that an elastic material could be used in its construction. The purpose of the backhand portion 56 is to connect the fingers portion 52 to the wrist portion 54, thereby securing the fingers portion 52 to the hand and preventing migration of the sleeves 58 on the middle fingers during shooting. Notably, the backhand portion 56 is shown as limited to the back of the user's shooting hand. According to a preferred aspect of the invention, the palm of the shooting hand remains completely exposed and is not covered by any portion of the glove 50 so as not to interfere with the shooting hand during the shooting motion. As such, the glove 50 can be worn during training as well as during a game without interfering with handling, including dribbling, of the basketball. However, it is foreseeable that limited portions of the palm could be covered by the glove 50, though preferably to avoid contact between the glove 50 and the ball during shooting other than where contact is made between the ball and the sleeves 58 and webs 60.

Figure 3:
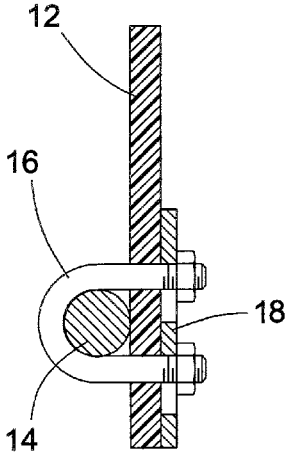
FIG. 3 represents a detailed cross-sectional view of one of the flexible paddles and the rim of FIG. 1.

As noted above, the apparatus 10 and glove 50 can be used together or separately. In the use of the apparatus 10, the paddles 12 are secured to the rim 14 as shown in FIGS. 1 through 3, and the user then shoots a basketball at the rim 14 and over the nearest paddle 12. The apparatus 10 encourages the shooter to align the shot with the nearest paddle 12 and forces the shooter to shoot the basketball with sufficient arc to travel over the nearest paddle 12 prior to entering the rim 14. To use the glove 50, a user is merely required to don the glove 50 on his or her shooting hand, and then shoot the basketball at the rim 14 (with or without the apparatus 10). During and after the shot, the fingers portion 52 of the glove 50 limits the movement and spreading of just the three middle fingers, which play a critical role in aligning the shot. In particular, the fingers portion 52 promotes proper support of a basketball with the three middle fingers throughout the shooting motion, promotes proper alignment of the three middle fingers with the forearm of the shooting hand while the user is shooting the basketball, and helps to maintain this alignment throughout the follow-through after the basketball has been released. All the while, the glove 50 allows and, because of the positioning of the three middle fingers, encourages the shooter to flex and spread the thumb and outer finger of the shooting hand away from the three middle fingers for the purpose of stabilizing the basketball on the shooting hand prior to releasing the basketball during the shooting movement.

While the invention has been described in terms of specific embodiments, it is apparent that other forms could be adopted by one skilled in the art. For example, the physical configuration of the apparatus 10 and glove 50 could differ from that shown, and materials and construction methods other than those noted could be used. Therefore, the scope of the invention is to be limited only by the following claims.

The invention claimed is:

1. A basketball shooting system comprising:

an apparatus adapted for mounting to a basketball rim, the apparatus comprising a plurality of flexible paddles, means for mounting the flexible paddles to the rim so that the flexible paddles project upwardly from the rim, and means coupled to the flexible paddles for adjustably modifying the rigidity of the flexible paddles; and a glove adapted to be worn on a shooting hand of a user when shooting a basketball at the rim, the glove comprising a fingers portion, a wrist portion, and a backhand portion, the fingers portion comprising three separate sleeves interconnected by a first elastic web between and attached to an adjacent first and second of the sleeves and by a second elastic web between and attached to the second sleeve and an adjacent third of the sleeves, the wrist portion comprising means for securing the glove to a wrist of the user, and the backhand portion interconnecting the fingers portion to the wrist portion;

wherein the glove is configured so that, when worn on the user's shooting hand, the palm of the user's shooting hand remains exposed and is not covered by the glove, the three middle fingers of the user's shooting hand are individually inserted into the sleeves and held together by the first and second elastic webs, at least the tips of the three middle fingers protrude from the sleeves, and the elasticity of the elastic material of the fingers portion enables the three middle fingers to be spread apart against an elastic tension created by the first and second elastic webs that maintains the three middle fingers closer to each other than to the thumb and outer finger of the user's shooting hand during shooting.

2. The basketball shooting system according to claim 1, wherein the apparatus comprises at least five of the flexible paddles.

3. The basketball shooting system according to claim 1, wherein the mounting means comprises a removable clamping assembly adapted to removably clamp the flexible paddles to an interior perimeter of the rim.

4. The basketball shooting system according to claim 1, wherein the mounting means comprises individual removable clamping assemblies each adapted to removably clamp a corresponding one of the flexible paddles to the rim.

5. The basketball shooting system according to claim 1, wherein the modifying means comprises plates coupled to the flexible paddles so as to abut surfaces of the flexible paddles facing the central axis of the rim, the plates being vertically adjustable so as to be adapted to increase and decrease the rigidity of the flexible paddles.

6. The basketball shooting system according to claim 5, wherein the flexible paddles and the mounting means are configured to cause the flexible paddles to extend about ten to fifteen centimeters above the rim when the flexible paddles are secured to the rim with the mounting means.

7. The basketball shooting system according to claim 1, wherein each of the flexible paddles has a width of about five to about ten centimeters in a circumferential direction of the rim when secured to the rim with the mounting means.

8. The basketball shooting system according to claim 1, wherein the flexible paddles are color-coded to have different colors to provide visual assistance to the user by differentiating as to which flexible paddle the user is facing and therefore must align a shot and shoot a basketball thereover.

9. The basketball shooting system according to claim 1, wherein the glove is configured so that the entire last joint of each of the three middle fingers protrudes from the sleeves.

10. The basketball shooting system according to claim 1, wherein the wrist portion is formed of an inelastic material.

11. The basketball shooting system according to claim 1, wherein the backhand portion is formed of an inelastic material.

12. The basketball shooting system according to claim 1, further comprising a ringlet attached to the backhand portion and positioned thereon for receiving the thumb of the user's shooting hand.

13. The basketball shooting system according to claim 12, wherein the ringlet is formed of an elastic material.

14. The basketball shooting system according to claim 1, further comprising a ringlet attached to the backhand portion and positioned thereon for receiving the outer finger of the user's shooting hand.

15. The basketball shooting system according to claim 14, wherein the ringlet is formed of an elastic material.

16. The basketball shooting system according to claim 1, wherein the glove is configured so that, when worn on the user's shooting hand, the palm of the user's shooting hand is not covered by any portion of the glove.

17. A training method using the apparatus according to claim 1, the method comprising:

installing the apparatus on the rim so that the flexible paddles force the user to shoot the basketball with sufficient arc so that the basketball travels over the flexible paddles prior to entering the rim, a first and a second of the flexible paddles being located diametrically opposite each other on the rim, at least a third of the flexible paddles being located equi-angularly from the first and second flexible paddles, at least a fourth of the flexible paddles being equi-angularly located between the first and third flexible paddles, and at least a fifth of the flexible paddles being equi-angularly located between the second and third flexible paddles; and shooting a basketball at the rim and over one of the flexible paddles secured to the rim.

18. A training method using the glove according to claim 1, the method comprising donning the glove on the shooting hand of the user and shooting a basketball at the rim.

* * * * *